US006684768B2

(12) United States Patent
Miyata et al.

(10) Patent No.: US 6,684,768 B2
(45) Date of Patent: Feb. 3, 2004

(54) STENCIL PRINTING MACHINE AND STENCIL PRINTING METHOD

(75) Inventors: Masakazu Miyata, Ibaraki-ken (JP); Masahiro Nishihata, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 70 days.

(21) Appl. No.: 09/761,864

(22) Filed: Jan. 18, 2001

(65) Prior Publication Data

US 2002/0007739 A1 Jan. 24, 2002

(30) Foreign Application Priority Data

Jan. 20, 2000 (JP) ..... 2000-011924

(51) Int. Cl.[7] ..... B41C 1/14
(52) U.S. Cl. ..... 101/128.4; 101/129
(58) Field of Search ..... 101/114, 48, 50, 101/127, 129, 128.4, 128.21

(56) References Cited

U.S. PATENT DOCUMENTS 5,329,848 A * 7/1994 Yasui et al. ..... 101/121
5,526,469 A * 6/1996 Brindle et al. ..... 395/109
5,640,904 A 6/1997 Sato et al.
5,881,336 A * 3/1999 Sato ..... 399/79
6,070,525 A * 6/2000 Watanabe et al. ..... 101/129
6,088,135 A * 7/2000 Kusumoto ..... 358/498
6,125,748 A * 10/2000 Inamine ..... 101/128.4
6,161,476 A * 12/2000 Yoneoka ..... 101/118
6,236,950 B1 * 5/2001 Grichnik ..... 702/66
6,295,924 B1 * 10/2001 Nishihata et al. ..... 101/116
6,317,802 B1 * 11/2001 Inamine ..... 710/64
6,330,012 B1 * 12/2001 Irie ..... 347/195

FOREIGN PATENT DOCUMENTS

EP 0 827 106 A2 * 4/1998

* cited by examiner

*Primary Examiner*—Ren Yan
(74) *Attorney, Agent, or Firm*—Kanesaka & Takeuchi

(57) ABSTRACT

A stencil printing machine includes an image reading section, an image processing section for processing to convert image data into perforating data which is used for perforating a stencil sheet, an image perforating section for perforating the stencil sheet in accordance with the perforating data, a printing section for applying ink to a print sheet by using the perforated stencil sheet, and a data holding section for holding perforating data in stencil making operation as re-perforating data. When the number of print sheets comes to a predetermined number, the re-perforating data held in the data holding section is used to re-perforate another stencil sheet to exchange with the previous stencil sheet. The printing is again performed.

9 Claims, 9 Drawing Sheets

STENCIL PRINTING MACHINE AND STENCIL PRINTING METHOD

BACKGROUND OF THE INVENTION

1. Field of the Invention

The present invention relates to a stencil printing machine and a stencil printing method for perforating and printing by using stencil sheet. Particularly, the present invention relates to a stencil printing machine and a stencil printing method capable of providing excellent printed image even in printing a large number of sheets.

2. Description of the Related Art

FIG. 10 is a block diagram showing an outline constitution of a stencil printing machine.

As shown by FIG. 10, a stencil printing machine 50 is generally constituted by an operation panel section 51 having operation keys and a display, an image reading section 52 such as an image scanner, a control section (CPU) 53, an image processing section 54, an image perforating section 55 for thermally perforating original document image to stencil sheet and a printing section 56 for printing by using stencil sheet formed with perforated image.

According to the stencil printing machine 50, there is carried out a control of operation of perforating and printing stencil sheet based on instruction of the control section 53 based on operation input from the operation panel section 51.

Further explaining, according to the stencil printing machine 50, when there is an input instructing start of stencil making operation from the operation panel section 51 provided at the main body, the image reading section 52 reads an image of a set original document. In parallel with the operation of reading the original document, the original document image is subjected to a processing of converting the original document image into binary data (perforating data) which is used for perforating by the image processing section 54. Further, based on the perforating data subjected to the conversion processing, the image perforating section 55 thermally perforates stencil sheet. Further, the perforated stencil sheet is mounted to a printing drum. Further, when there is an input instructing start of printing operation from the operation panel section 51, printing operation of a number of sheets set and inputted from the operation panel section 51 is carried out at the printing section 56.

Further, as other constitution, there is known a stencil printing system, wherein a data editing apparatus such as a personal computer is connected to a stencil printing machine via an interface apparatus (data developing apparatus). According to the stencil printing system, image data from the data editing apparatus such as a personal computer is subjected to a processing of converting the image data into binary data (perforating data) which is used for perforating by the data developing apparatus and stencil sheet is thermally perforated based on perforating data of one edition subjected to the conversion processing and transferred.

According to such a stencil printing machine or stencil printing system, a large number of sheets of printing can be carried out in a short period of time and at high speed by rotating the printing drum at high speed.

Meanwhile, most of stencil sheet used in a stencil printing machine or a stencil printing system of this kind is constituted by pasting together a thermally-sensitive film and a porous supporter and is provided with print resistance function to some degree. However, there is a limit in a number of sheets which can be printed in one operation.

Therefore, when there is carried out printing operation of stencil sheet by a durable number of print sheets for each stencil sheet or more, slender lines or horizontal rules perforated on the stencil sheet are cut or paper powder of print sheet is adhered to the stencil sheet. Further, with an increase in a number of sheets of printing, deteriorations of print image caused by paper powder occurs. Further, the stencil sheet is gradually elongated by tension in printing and printed image is also elongated. As a result, image quality of printed image is deteriorated and printed matter having excellent image quality cannot be provided.

Therefore, according to a conventional stencil printing machine or a stencil printing system, when one original document is intended to print by the durable number of print sheets for each stencil sheet or more of stencil sheets, the stencil sheet which has been used is discharged. Further, after carrying out again processings of the same image data (reading processing, processing of developing to perforating data, processing of transferring data), a new one of stencil sheet must be perforated again.

Further explaining, when stencil making operation is carried out by reading original document by an image scanner, the stencil making operation must be carried out again by reading the same original document by the image scanner by one more time.

When the stencil making operation is carried out by transferring image data from a data editing apparatus such as a personal computer, the stencil making operation must be carried out by transferring again the image data by one more time.

Further, when the stencil making operation is carried out again from original document, there is a case in which printed matter the same as that in the first time cannot be provided by a positional shift of original document or an error in reading the original document by an image scanner and there poses a problem of being devoid of reproducibility.

When the stencil making operation is carried out again by image data from a data editing apparatus such as a personal computer, the positional shift in perforating is difficult to cause. However, since image data of the data editing apparatus is again converted into binary data which is used for perforating and transferred, a time period of developing image is extraneously taken, causing loss in operational time period.

SUMMARY OF THE INVENTION

Hence, the present invention has been carried out in view of the above-described problem and it is an object thereof to provide a stencil printing machine and a stencil printing method capable of carrying out desired stencil printing by shortening an operational time period without causing a shift in a stencil position by holding data which has been made once and using the held data in stencil making again.

In order to achieve the above-described object, according to a first aspect of the present invention, there is provided a stencil printing machine including:

- a conversion processing section (image processing section 2*c* or data developing apparatus 8) for processing to convert image data into perforating data capable of being perforated to a stencil sheet,
- a data holding section 5 for holding the perforating data subjected to the conversion processing as re-perforating data; and
- a printing section 3 for perforating the stencil sheet based on the perforating data subjected to the conversion processing and printing a print sheet by using the perforated stencil sheet.

According to the aspect of the present invention, the perforating data subjected to the conversion processing by the conversion processing section 2*c* or 8 is held in the data holding section 5. Therefore, it is not necessary to carry out again the processing of the image data (reading processing, processing of developing the image data to the perforating data, processing of transferring data).

According to a second aspect of the present invention, there is provided the stencil printing machine including:

an image reading section 2*a* for reading an image of an original document, an image processing section 2*c* for processing to convert image data read by the image reading section 2*a* into the perforating data which is used for perforating to the stencil sheet, an image perforating section 2*b* for thermally perforating the stencil sheet in accordance with the image of the perforating data from the image processing section 2*c*, a printing section 3 for printing a print sheet by using the stencil sheet perforated by the image perforating section 2*b*, and a data holding section 5 for holding the perforating data as re-perforating data in parallel with perforating operation of the stencil sheet by the perforating data.

According to the aspect of the present invention, even when the stencil sheet is perforated by reading the original document by the image reading section 2*a*, the perforating data is held in the data holding section 5. Therefore, it is not necessary to read again the same original document by the image reading section 2*a* for re-perforation.

According to a third aspect of the present invention, there is provided the stencil printing machine including:

a data editing apparatus 7 for editing and outputting image data, a data developing apparatus 8 for developing the image data outputted from the data editing apparatus 7 into the perforating data which is used for perforating the stencil sheet;

an image perforating section 2*b* for thermally perforating the stencil sheet in accordance with the image of the perforating data developed by the data developing apparatus 8, a printing section 3 for printing a print sheet by using the stencil sheet perforated by the image perforating section 2*b*, and a data holding section 5 for holding the developed perforating data as re-perforating data.

According to the aspect of the present invention, even when the stencil sheet is perforated by transferring the image data from the data editing apparatus such as a personal computer, the perforating data is held in the data holding section 5. Therefore, it is not necessary to transfer again the image data for re-perforation.

According to a fourth aspect of the present invention, there is provided the stencil printing machine according to the stencil printing machine of any one of the first through the third aspects, further including, a control section 4 for perforating the stencil sheet by reading the re-perforating data held in the data holding section 5 by an instruction input of stencil remaking operation from an operation panel section 1 provided at the machine main body.

The stencil remaking operation is reading the re-perforating data from the data holding section 5 and thereafter, thermally perforating a stencil sheet in accordance with the image of the re-perforating data. Further, it may be included winding the perforated stencil sheet around a printing drum after thermally perforating.

According to the aspect of the present invention, the instruction input of the stencil remaking operation is inputted from the operation panel section 1 by an operator. Therefore, the stencil remaking operation can arbitrary be executed during the printing operation. Further, in a stencil printing machine in which the stencil sheet is removed manually from the printing drum, the stencil remaking operation can be carried out at an arbitrary timing after removing the stencil sheet by an operator.

According to a fifth aspect of the present invention, there is provided the stencil printing machine according to the stencil printing machine of any one of the first through the third aspects, further including:

a control section 4 for perforating the stencil sheet by the re-perforating data held in the data holding section 5 at every time at which an accumulated number of print sheets reaches a product of a previously set restricted number of sheets A multiplied by an integer n.

According to the aspect of the present invention, the stencil remaking operation can be carried out automatically.

According to a sixth aspect of the present invention, there is provided a stencil printing method including the steps of processing to convert image data into perforating data which is used for perforating a stencil sheet, perforating the stencil sheet based on the perforating data subjected to the conversion processing and holding the perforating data subjected to the conversion processing as re-perforating data, and printing a print sheet by using the perforated stencil sheet.

According to a seventh aspect of the present invention, there is provided the stencil printing method according to the stencil printing method of the sixth aspect, wherein the stencil sheet is perforated by the held re-perforating data at every time at which a printing operation is started and an accumulated number of print sheets reaches a product of a previously set restricted number of sheets A multiplied by an integer n.

DETAILED DESCRIPTION OF THE PREFERRED EMBODIMENTS

Figure 1:
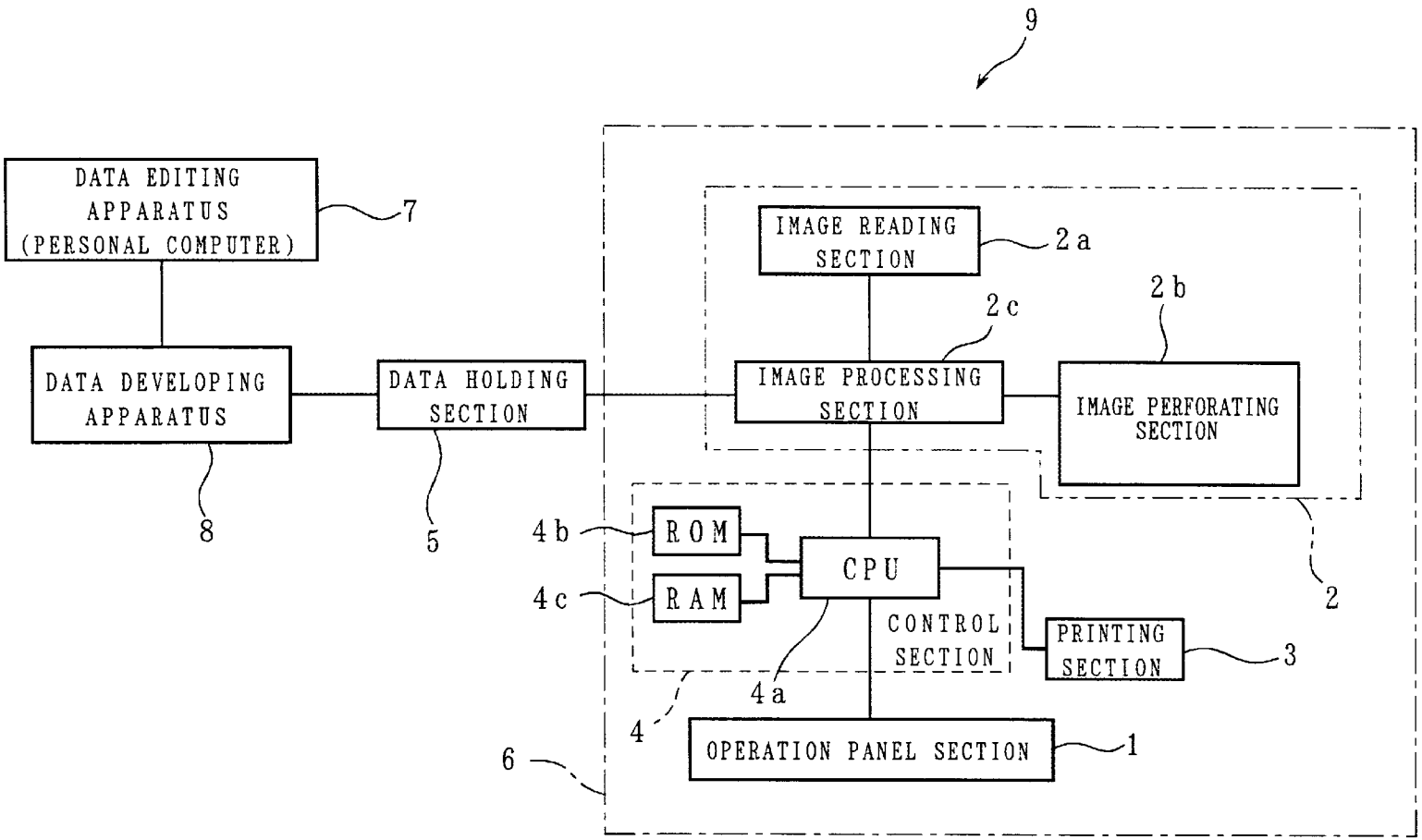
FIG. 1 is a block diagram showing an outline constitution of an embodiment according to the present invention.
Figure 2:
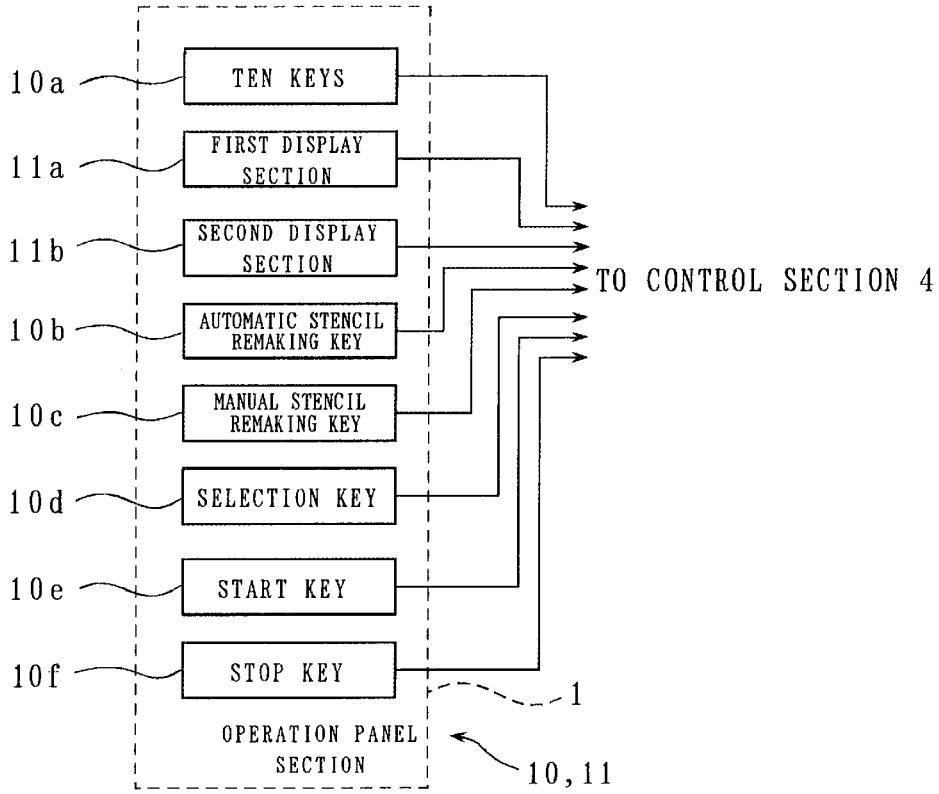
FIG. 2 is a view showing a constitution of an operation panel section of FIG. 1.
Figure 3:
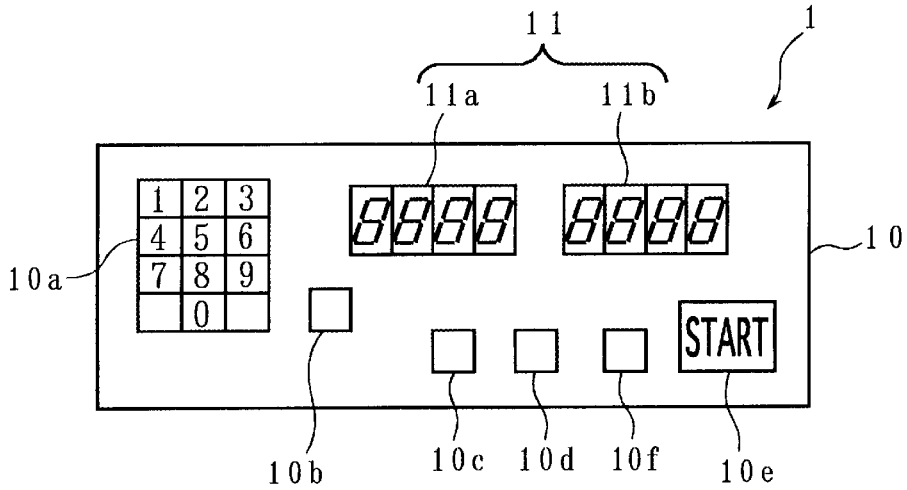
FIG. 3 is a plan view of the operation panel section of FIG. 1.

FIG. 1 is a block diagram showing an outline constitution of an embodiment according to the present invention, FIG. 2 is a view showing a constitution of an operation panel section of FIG. 1, and FIG. 3 is a plan view of the operation panel section of FIG. 1.

As shown by FIG. 1, according to the embodiment, a stencil printing system 9 is constituted by a stencil printing machine 6 having an operation panel section 1, a stencil making section 2, a printing section 3, a control section 4 and a data holding section 5, a data editing apparatus 7 and a data developing apparatus 8.

As shown by FIG. 3, the operation panel section 1 provided at the machine main body is provided with operating means 10 and displaying means 11 and an operation input of the operating means 10 is inputted to the control section 4.

As shown by FIG. 2 and FIG. 3, operating means 10 is provided with a plurality of keys. Ten keys 10*a* are keys for setting a number of print sheets, a durable number of print sheets for each stencil sheet and the like. An automatic stencil remaking key 10*b* is a key for setting an automatic stencil remaking mode, mentioned later. A manual stencil remaking key 10*c* is a key for manually instructing stencil remaking operation by re-perforating data held in the data holding section 5. A selection key 10*d* is a key for selecting stencil making operation or print operation. A start key 10*e* is a key for starting operation. A stop key 10*f* is a key for stopping operation.

Stencil making operation is the operation from reading an original document by the image reading section 2*a* to thermally perforating a stencil sheet (or to winding the perforated stencil sheet around a printing drum).

The displaying means 11 includes a first display section 11*a* for displaying a number of sheets capable of being printed in one stencil making operation (durable number of print sheets for each stencil sheet) and a second display section 11*b* for displaying a total set number of print sheets (and number of remaining print sheets) which are operably inputted. As shown by FIG. 3, the first display section 11*a* and the second display section 11*b* each is arranged with 4 digits of LEDs each comprising 7 segments and a maximum of a number of 9999 sheets can be displayed.

The stencil making section 2 comprises an image reading section 2*a*, an image perforating section 2*b* and an image processing section 2*c*. The image reading section 2*a* is constituted by, for example, an image scanner. The image reading section 2*a* reads an image of set original document. The read image data is transmitted to the image perforating section 2*b* by the image processing section 2*c* and, at the same time, held in the data holding section 5 as re-perforating data.

The image perforating section 2*b* is provided with a thermal head. The image perforating section 2*b* thermally perforates a stencil sheet based on image data inputted from the image processing section 2*c*. The image data inputted to the image perforating section 2*b* is data in which, for example, "1" corresponds to data of perforating a stencil sheet and "0" corresponds to data of not perforating a stencil sheet.

When a stencil sheet is perforated by the image data read by the image reading section 2*a*, the image processing section 2*c* subjects inputted image data to conversion processing into binary data which is used for perforating a stencil sheet (perforating data). The image processing section 2*c* transfers the processed perforating data simultaneously to the data holding section 5 and the data perforating section 2*b*.

In contrast thereto, when a stencil sheet is perforated by image data transferred from the data editing apparatus 7 via the data developing apparatus 8, the image processing section 2*c* transfers binary image data (perforating data) developed into data which is used for perforating and transmitted from the data developing apparatus 7 to the image perforating section 2*b*.

Further, when stencil remaking operation is instructed, the image processing section 2*c* reads re-perforating data of one edition held in the data holding section 5 and transfers the re-perforating data to the image perforating section 2*b* by instruction from the control section 4.

The printing section 3 is constituted by a paper feed section, a drum and a paper discharge section. The paper feed section feeds a print sheet. The drum is attached with a stencil sheet and prints a print sheet by being rotated. The paper discharge section discharges a print sheet printed by the drum.

Although not particularly illustrated, a further explanation will be given of an example of a constitution of the printing section 3. The drum is attached interchangeably to the machine main body. Further, the drum is provided with a printing drum in a cylindrical shape rotatably supported around a central axis line of its own. The printing drum is constituted in a porous structure. The printing drum is provided with a clamp mechanism for locking one end of a stencil sheet. The printing drum is driven to rotate in one direction by power of a drum motor.

Print ink supplying means is provided at an inner portion of the printing drum. According to the print ink supplying means, an outer peripheral face thereof is arranged to be brought into contact with an inner peripheral face of the printing drum. The print ink supplying means is provided with a squeegee roller and a doctor roller. The squeegee roller is rotatable around a central axis of its own. The doctor roller is extended along a circumferential line of the squeegee roller with a predetermined interval relative to an outer peripheral face of the squeegee roller. The print ink supplying means supplies print ink at an ink storage to the inner peripheral face of the printing drum by driving the squeegee roller in synchronism with rotation of the printing drum in a direction same as that of the printing drum.

In accordance with rotation of the squeegee roller driven in cooperation with and in synchronism with rotation of the printing drum, the print ink at the ink storage passes through a gap between the squeegee roller and the doctor roller. There is formed a print ink layer having a uniform thickness on the outer peripheral face of the squeegee roller. The print ink layer is provided to printing by being supplied to the inner peripheral face of the printing drum in accordance with rotation of the squeegee roller. At an outer side position of the printing drum opposed to the squeegee roller, there is provided a press roller as a roller member for bringing a print sheet into press contact with the outer peripheral face of the printing drum by predetermined pressure.

The paper feed portion is provided with a paper feed base for loading print sheets and a paper feed mechanism for feeding a print sheet on the paper feed base to a side of the printing drum. The paper feed base is moved upwardly and downwardly by a drive apparatus in correspondence with an amount of loading set print sheets. The paper feed mechanism is constituted by providing a paper feed roller comprising rubber or the like and a pair of timing rollers. The paper feed roller picks up a topmost one of print sheets loaded on the paper feed base sheet by sheet and transfers the print sheet to the timing rollers. The timing rollers temporarily hold the print sheet transferred from the paper feed roller in a bent state. Further, the timing rollers feed the print sheet between the printing drum and the press roller at pertinent timings.

The paper discharge section is provided with a paper discharge apparatus constituted by a print sheet separating claw for removing printed sheet finished with printing from above the printing drum and a belt conveyer apparatus for transferring printed sheet exfoliated by the print sheet separating claw and a paper discharge base for loading and containing printed sheet transferred by the paper discharge apparatus.

The control section 4 carries out stencil making and printing by controlling the stencil making section 2 and the printing section 3 based on key operation of the operation panel section 1. The control section 4 is constituted by hardwares of CPU 4*a* constituting a central processing unit, ROM 4*b* and RAM 4*c* constituting storing means and I/F and control programs of stencil making operation, stencil remaking operation and printing operation.

The data holding section 5 is constituted by a memory apparatus (storing means) having a predetermined memory area. The data holding section 5 stores and holds perforating data based on the image data of the image reading section 2*a* transferred from the image processing section 2*c* and perforating data based on image data of the data editing apparatus 7 transmitted from the data developing apparatus 8 by allocating the perforating data to one edition of data memory area as re-perforating data.

The data editing apparatus 7 is constituted by a terminal apparatus of, for example, a personal computer constituted separately from the stencil printing apparatus 6. In the data editing apparatus 7, image data for thermally perforating a stencil sheet is edited. Further, the editing apparatus 7 outputs desired image data to the data developing apparatus 8 by an operation input of an input apparatus such as a keyboard or a mouse.

The data developing apparatus 8 develops image data from the data editing apparatus 7 into binary data (perforating data) which is used for perforating a stencil sheet. The developed binary perforating data is held to the data holding portion 5 as re-perforating data and transmitted to the image processing unit 2*c*.

Figure 4:
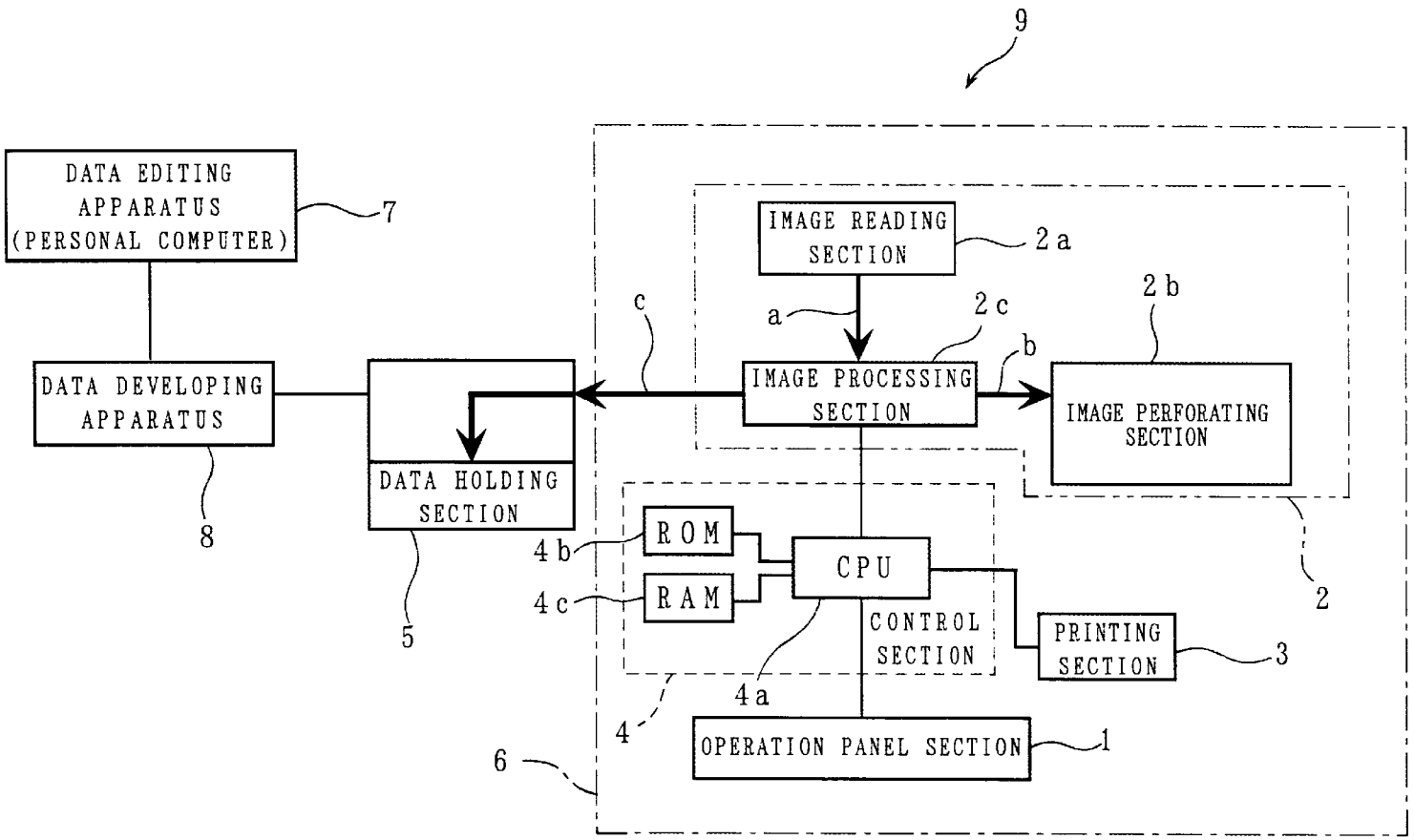
FIG. 4 is a block diagram showing flow of data when stencil making is carried out based on image data read by an image reading section.

Next, an explanation will be given of operation when stencil making is carried out based on image data read by the image reading section 2*a* by the stencil printing system 9 in reference to FIG. 4. Further, arrow marks in FIG. 4 show flow of data.

First, an original document is set to the image reading section 2*a*. Further, stencil making operation is selected by operating the selection key 10*d* of the operational panel section 1. When start of stencil making operation is instructed and inputted to the control section 4 by depressing the start key 10*e*, the image reading section 2*a* reads an image of set original document. The read image data of original document (multiple value data) is transmitted to the image processing section 2*c* (arrow mark a of FIG. 4). At the image processing section 2*c*, image data transmitted from the image reading section 2*a* is transmitted to the image perforating section 2*b* while converting the image data into perforating data (binary data) (arrow mark b of FIG. 4). Further, the image perforating section 2*b* thermally perforates a stencil sheet by image of perforating data from the image processing section 2*c*. In parallel with the perforating operation, perforating data at that time is held at a memory area of the data holding section 5 as re-perforating data (arrow mark c of FIG. 4).

Next, an explanation will be given of operation when stencil making is carried out based on image data from the data editing apparatus 7 by the stencil printing system 9. Further, arrow marks in FIG. 5 show flow of data.

Figure 5:
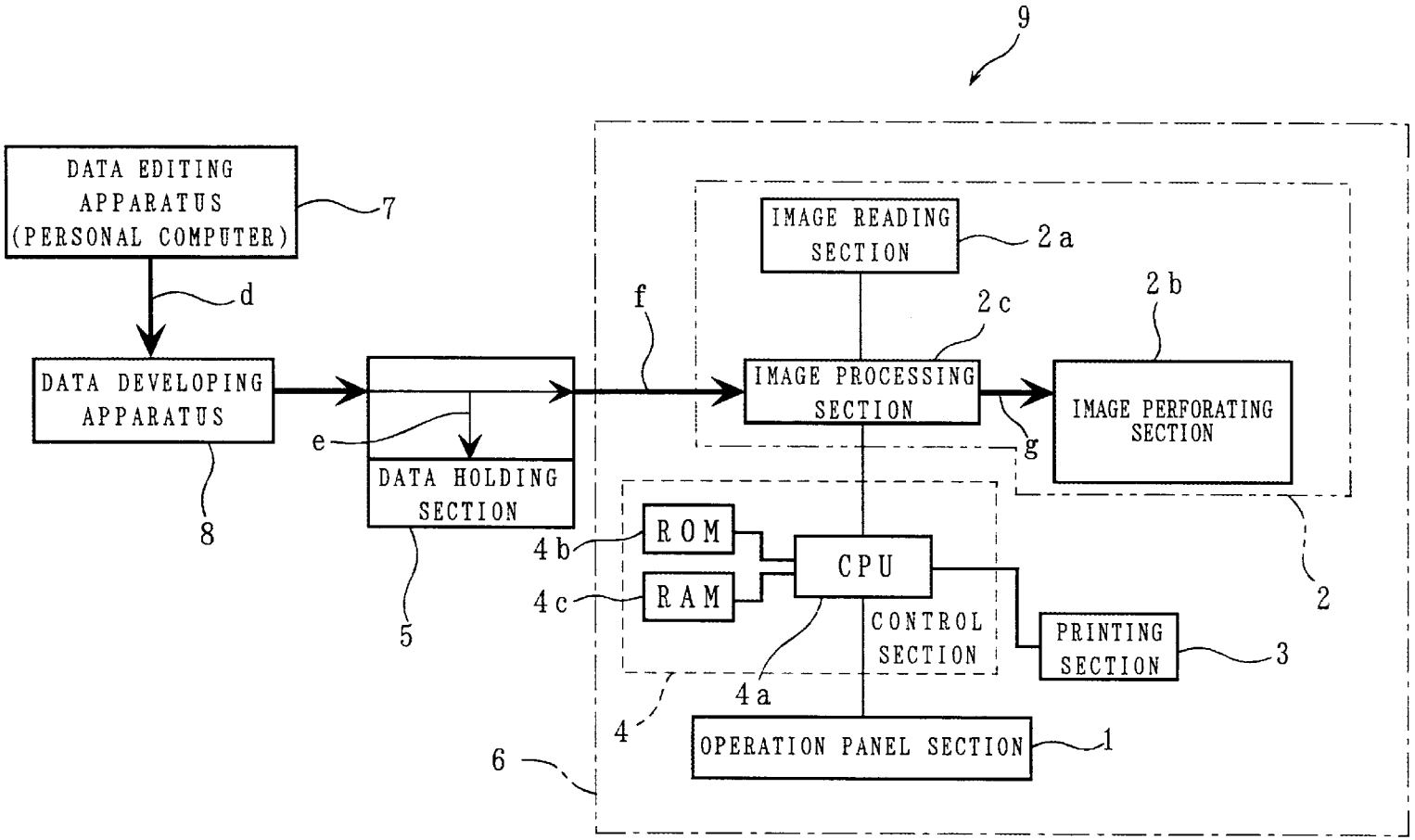
FIG. 5 is a block diagram showing flow of data when stencil making is carried out based on image data from a data editing apparatus.

First, image data constituting basis of stencil image (multiple value data such as compressed data, postscript or the like) is transmitted from the data editing apparatus 7 to the data developing apparatus 8 by being selected by the operation input of a keyboard or a mouse (arrow mark d of FIG. 5). At the data developing apparatus 8, image data from the data editing apparatus 7 is developed into binary data (perforating data) which is used for perforating a stencil sheet by the image perforating section 2*b*. Further, one edition of perforating data developed by the data developing apparatus 8 is held in a memory area of the data holding section 5 as re-perforating data (arrow mark e of FIG. 5) and is transferred to the image processing section 2*c* (arrow mark f of FIG. 5). At the image processing section 2*c*, one edition of perforating data transmitted from the data developing apparatus 8 is transferred to the image perforating section 2*b* (arrow mark g of FIG. 5). Further, the image perforating section 2*b* thermally perforates a stencil sheet based on perforating data from the image processing section 2*c*.

Figure 6:
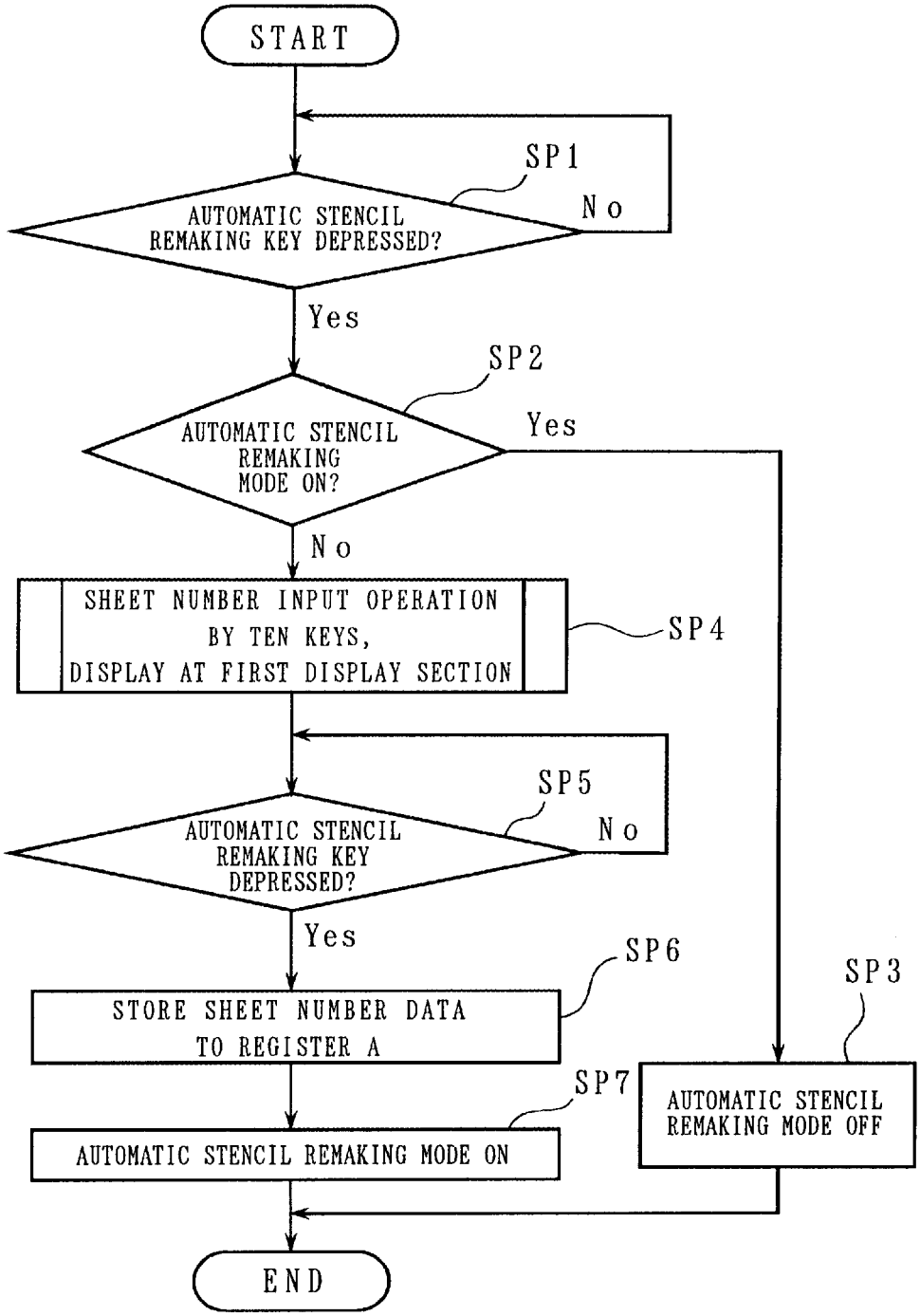
FIG. 6 is a flowchart showing operation of setting an automatic stencil remaking mode.
Figure 7:
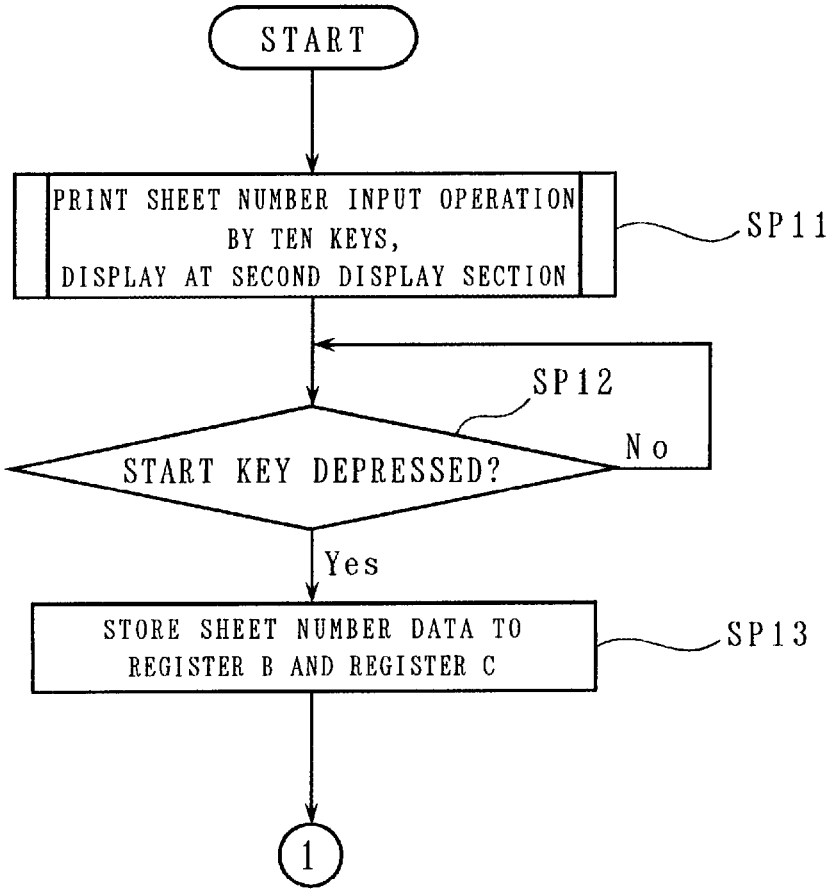
FIG. 7 is a flowchart showing operation in setting the automatic stencil remaking mode.
Figure 8:
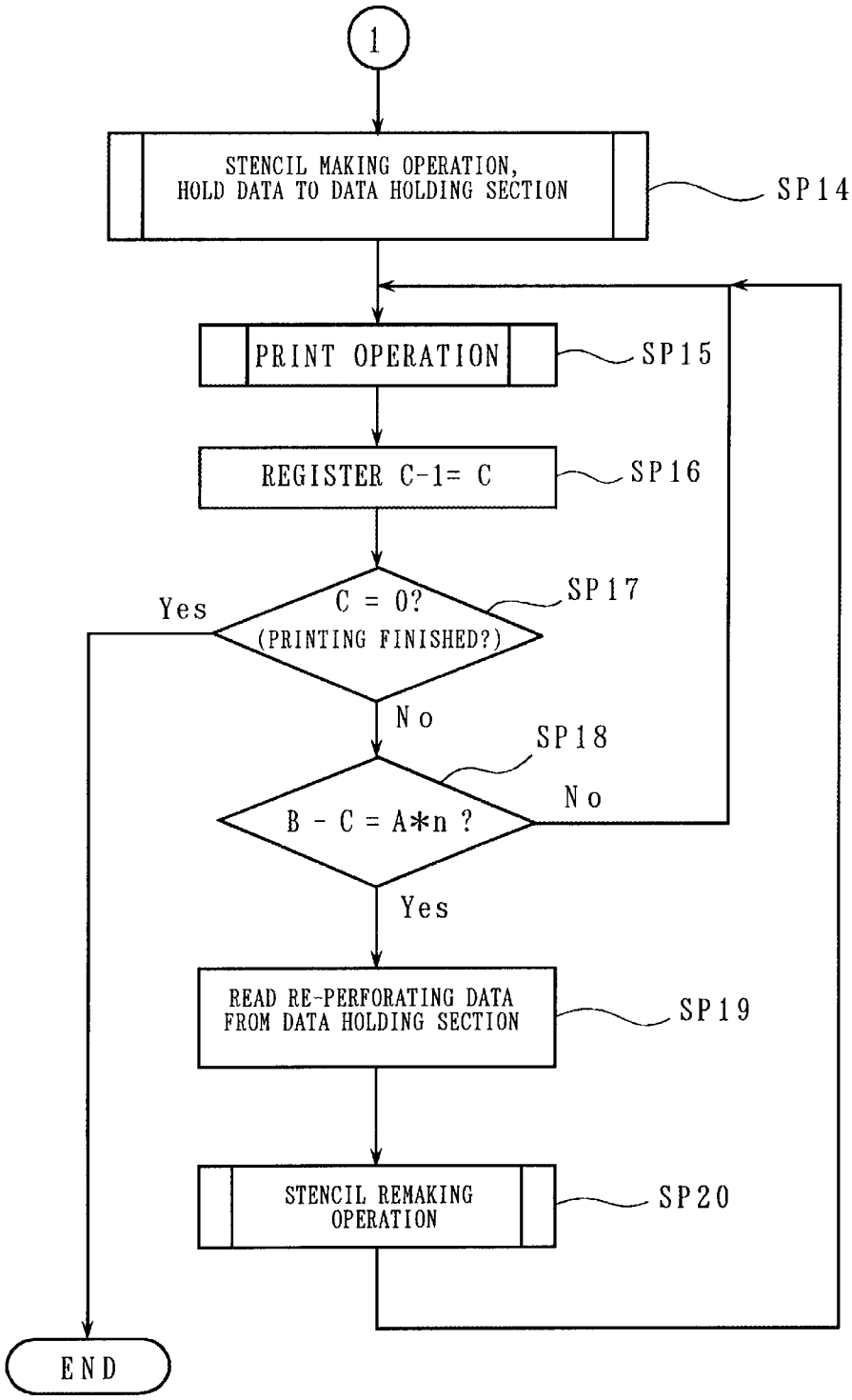
FIG. 8 is a flowchart showing the operation in setting the automatic stencil remaking mode continued from FIG. 7.
Figure 9:
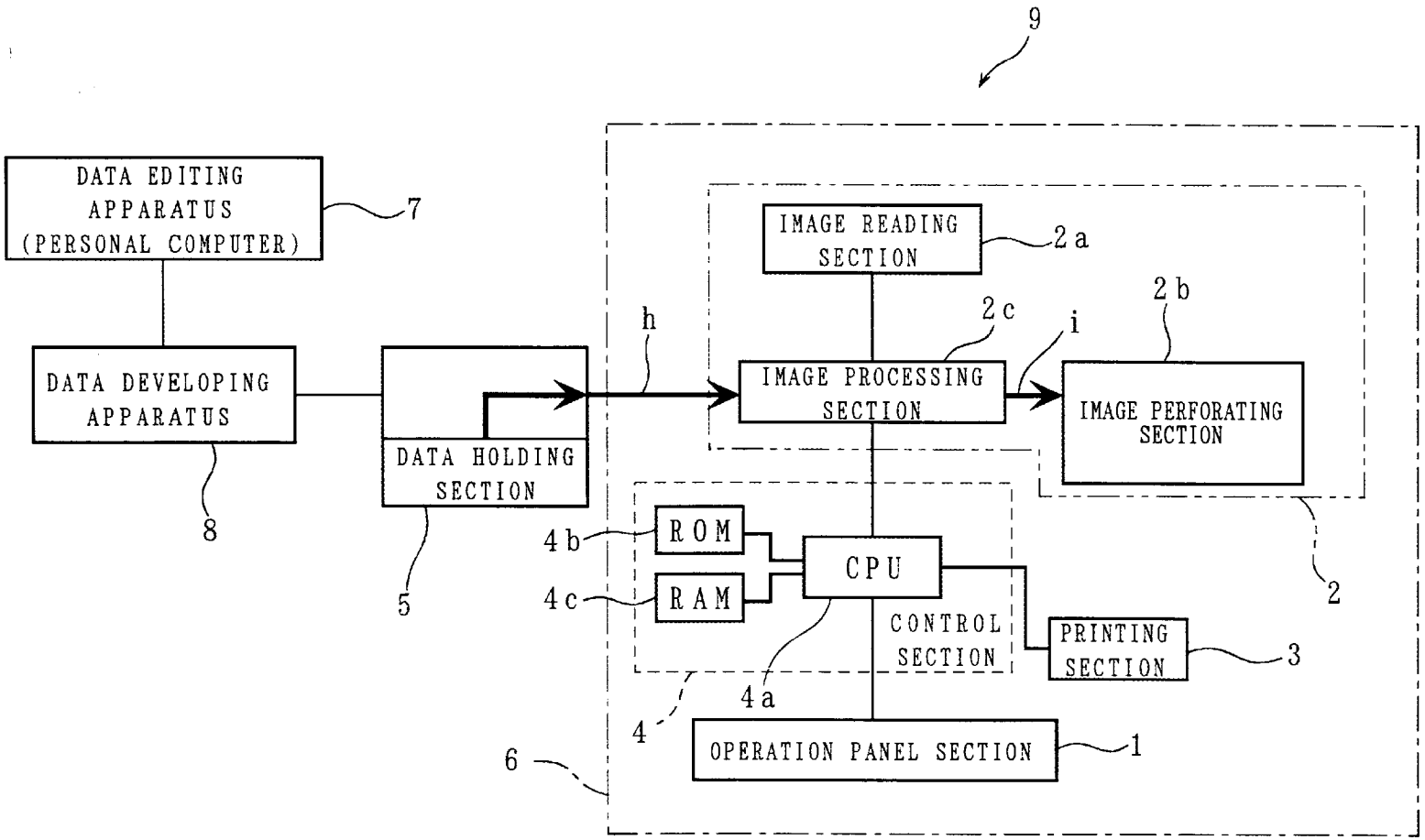
FIG. 9 is a block diagram showing flow of data when stencil making (stencil remaking) is carried out by re-perforating data held in a data holding section.
Figure 10:
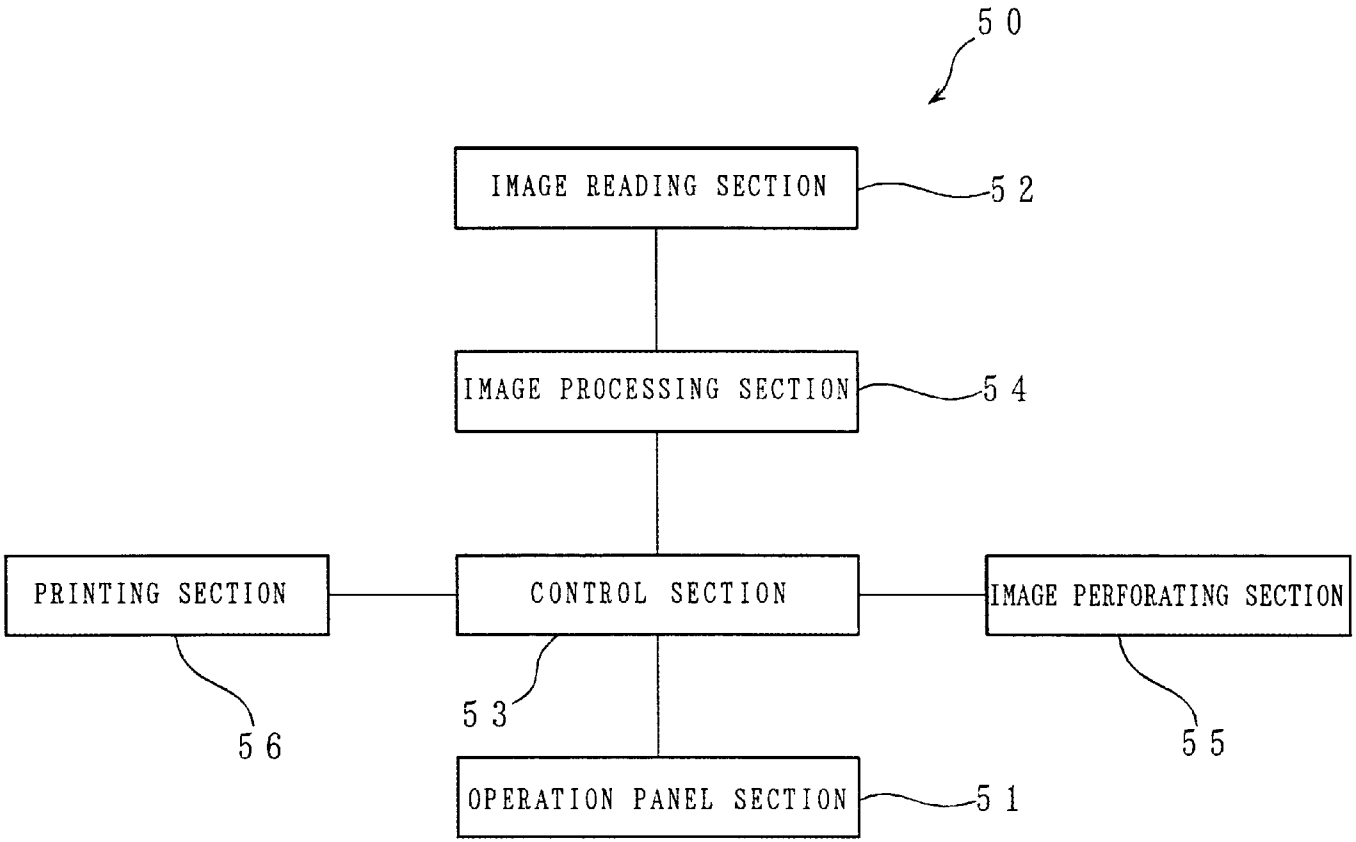
FIG. 10 is a block diagram showing an outline constitution of a conventional stencil printing machine.

Next, FIG. 6 is a flowchart showing operation of setting an automatic stencil remaking mode, FIG. 7 and FIG. 8 are flowcharts showing operation when the automatic stencil remaking mode is set and FIG. 9 is a block diagram showing flow of data when stencil making (stencil remaking) is carried out by re-perforating data held by the data holding section 5.

An explanation will be given of operation of setting the automatic stencil remaking mode in reference to FIG. 6.

When the automatic stencil remaking key 10*b* is depressed (SPI-Yes), in the case in which the control section 4 determines that the automatic stencil remaking mode is made ON (SP2-Yes), the automatic stencil remaking mode is made OFF (SP3).

In contrast thereto, when the automatic stencil remaking key 10*b* is depressed (SP1-Yes) in the case in which the control section 4 determines that the automatic stencil remaking mode is not made ON (SP2-No), the control section 4 awaits that a restricted number of sheets (durable number of print sheets for each stencil sheet) executed by one sheet (one time) of perforating is inputted by an operator by the ten keys 10*a*. When the restricted number of sheets is inputted, the restricted number of sheets is displayed at the first display section 11*a* (SP4). The restricted number of sheets is set to a number of sheets within a limit of capable of maintaining image quality (that is, image quality is determined to deteriorate by printing further). In this case, for example, 2000 are set and displayed.

Next, when the automatic stencil remaking key 10*b* is depressed again (SP5-YES), the restricted number of sheets is stored to a register A (SP6). The register A is a predetermined area of CPU 4*a* or RAM 4*c*. In this case, the register A is stored with 2000 sheets. Thereby, the automatic stencil remaking mode is set to ON (SP7). By the setting, the stencil printing system 9 thereafter carries out operation of stencil-making and printing by the automatic stencil remaking mode.

The operation of setting the automatic stencil remaking mode can be set at a predetermined timing by an operator or a controller. That is, according to setting of the controller of the system, the system can be always operated by the automatic stencil remaking mode. In contrast thereto, when the operator arbitrarily sets the automatic stencil remaking mode, the system can be operated by the automatic stencil remaking mode only when used by the operator.

Next, an explanation will be given of operation of the system under the automatic stencil remaking mode in reference to flowcharts of FIG. 7 and FIG. 8.

First, when a set number of print sheets is operably inputted by the ten keys 10*a*, the inputted set number of print sheets is numerically displayed at the second display section 11*b* (SP11). For example, when the set number of print sheets is 6000, 6000 are set and displayed.

Next, when the start key is depressed in a state in which stencil making operation is selected by the selection key 10*d* (SP12-Yes), the set number of print sheets is stored to a register B and a register C (SP13). Further, the above-described stencil making operation shown in FIG. 4 or FIG. 5 is carried out. Perforating data in the stencil making operation is held at a memory area of the data holding section 5 as re-perforating data (SP14).

When a stencil sheet is thermally perforated by the stencil making operation, thereafter, the printing section 3 locks one end of the perforated stencil sheet by the clamp mechanism of the printing drum and reels the stencil sheet around the printing drum. Further, printing operation is started (SP15). That is, print sheets are fed sheet by sheet to the gap between the printing drum and the press roller by the paper feed section and the print sheet is brought into press contact with the outer peripheral face of the printing drum by the press roller under predetermined pressure. Print ink from the ink supplying means provided at the inner portion of the printing drum is transcribed onto the print sheet by passing through perforated portions of the stencil sheet. Thereby, desired printing is carried out. The printed sheet is exfoliated from the printing drum and is discharged to the discharge section.

The control section 4 subtracts 1 from the register C by one sheet of printing and updates content of the register C (SP16). Simultaneously therewith, the second display section 11*b* displays a number of sheets subtracted by one sheet from a number of sheets which has been displayed. At this occasion, according to the above-described example, since one sheet is subtracted, 5999 are displayed.

The above-described printing operation is continued until finishing to print the number of print sheet (6000 sheets) inputted by the operator. That is, during a time period until satisfying (SP17-No), the operation proceeds to SP18.

Next, the control section 4 determines whether the number of print sheets reaches the restricted number of sheets (SP18). In this case, it is determined whether a value produced by subtracting a value of the register C from a value of the register B, that is, the restricted number of sheets A set with a number of sheets of finishing printing operation, multiplied by n (integer larger than 0) is reached.

According to the example, since the restricted number of sheets is 2000, during a time period until an accumulated number of print sheets reaches 2000 sheets (SP18-No), the operation proceeds to SP15 and printing operation is continued.

When the accumulated number of print sheets reaches 2000 (SP18-Yes), printing operation by perforating one time (one stencil sheet) is temporarily stopped. Thereby, printing by one time (one stencil sheet) of perforating is up to 2000 set by the restricted number of sheets. Further, re-perforating data is read from the data holding section 5 (SP19) and the stencil remaking operation is executed by the read re-perforating data (SP20).

That is, according to the stencil remaking operation, by instruction from CPU 4*a*, locking of the clamp mechanism at the printing drum is released and the stencil sheet reeled to the printing drum is discharged. Further, by the read re-perforating data, a stencil sheet is thermally perforated. Thereafter, the perforated stencil sheet is cut by a previously set length. Further, the printing section 3 locks one end of the perforated stencil sheet by the clamp mechanism of the printing drum and reels the stencil sheet around the printing drum. After that, by instruction from CPU 4*a*, printing operation at a second time is started (SP15).

Since the set number of print sheets is 6000, a total of three times of stencil making operation is carried out. Two times in the three times are stencil remaking operation based on re-perforating data held by the data holding section 5. Further, printing operation is finished after carrying out continuous printing of respective 2000 sheets by a total of three times (SP17-Yes).

In this way, in the case in which the automatic stencil remaking mode is set by depressing the automatic stencil remaking key 10*b*, during the printing operation, when the number of print sheets reaches the restricted number of sheets, the printing operation is temporarily stopped automatically. Further, stencil remaking operation by the re-perforating data held in the data holding section 5 is carried out. Further, after the stencil remaking operation, until the set number of print sheets is finished, the printing operation is continued.

Further, when stencil remaking operation is arbitrary executed in the printing operation, the following processing is carried out. First, when the manual stencil remaking key 10*c* is depressed, instruction of stencil remaking is interruptingly inputted to the control section 4. Thereby, printing operation is interrupted. Further, as shown by FIG. 9, the image processing section 2*c* reads re-perforating data from the memory area of the data holding section 5 and transfers the re-perforating data to the image perforating section 2*b* (arrow marks h, i of FIG. 9). The image perforating section 2*b* thermally perforates a stencil sheet by image of the re-perforating data from the image processing section 2*c*. After finishing the stencil remaking operation, when the start key 10*e* is depressed, the interrupted printing operation is restarted.

Further, although according to the above-described embodiment, the re-perforating data held by the data holding section 5 is data of one edition, data of a plurality of editions may be held. In this case, re-perforating data held by the data holding section 6 is displayed on a display screen, not illustrated, and the selection is carried out by key operation of the operation panel section 1 (for example, using both of the ten keys 10*a* and the mode setting key 10*b*). Thereby, stencil remaking operation can be carried out by utilizing not only data at a preceding time but also data therebefore.

In this way, according to the embodiment, in parallel with the perforating operation, image data developed to binary values of one edition or a plurality of editions can be held at the data holding portion 5 as re-perforating data.

Further, when printing is carried out by the restricted number of sheets (durable number of print sheets for each stencil sheet) or more, by perforating a stencil sheet again by using re-perforating data held in data holding section 5, printing of a necessary number of sheets can be carried out by shortening stencil making time without causing a shift in reading.

Further, when stencil remaking operation is carried out by image data from the data editing apparatus 7 in which stencil making operation has been carried out, image data developed into binary values which is used for perforating has already been held in the data holding section 5 as re-perforating data. Therefore, developing processing operation by the data developing apparatus 8 as in the conventional apparatus is dispensed with. Further, the processing time can be shortened by that amount.

Further, according to the embodiment, an explanation has been given of a constitution in which perforating by image data of original document read by the image reading section 2*a* and perforating by image data transferred from the data editing apparatus 7 can be carried out selectively. However, there may be constructed a constitution in which the image reading section 2*a* is omitted or a constitution in which the data editing apparatus 7 and the data developing apparatus 8 are omitted in FIG. 1.

As is apparent from the above-described explanation, according to the invention, when a stencil sheet is perforated by the stencil making section on the basis of image data inputted from the image reading section such as an image scanner or the data editing apparatus such as a personal computer, in parallel with the perforating operation, data which is used for perforating of one edition or a plurality of editions can be held as re-perforating data. Further, when printing is carried out by the restricted number of sheets (durable number of print sheets for each stencil sheet) or more, by again perforating a stencil sheet by using held re-perforating data, there can be carried out a necessary number of sheets of printing by shortening stencil making time without causing a shift in reading.

Further, when stencil remaking operation is carried out by image data from the data editing apparatus in which stencil making operation has been carried out, re-perforating data developed into data which is used for perforating is already held in the data holding section. Therefore, operation of developing processing by the data developing apparatus as in the conventional apparatus is dispensed with and processing time can be shortened by that amount.

What is claimed is:

1. A stencil printing machine comprising:

a conversion processing section for processing to convert input image data into perforating data;

a data holding section electrically connected to the conversion processing section for holding the perforating data as re-perforating data;

a control section electrically connected to the data holding section for controlling stencil making and printing operations, said control section, if required, retrieving the perforating data held in the data holding section as the re-perforating data;

a stencil making section electrically connected to the control section for perforating a stencil sheet based on the perforating data subjected to the conversion processing and re-perforating another stencil sheet based on the re-perforating data by an operation of the control section;

a printing section for printing a print sheet by using the perforated stencil sheet; and an operation panel section electrically connected to the control section and having a manual stencil making key for manually instructing a stencil remaking operation by the re-perforating data held in the data holding section, said control section reading the re-perforating data held in the data holding section and operating the stencil making section to perforate the another stencil sheet by an instruction input of a stencil remaking operation from the operation panel section.

2. A stencil printing machine comprising:

an image reading section for reading an image of an original document;

an image processing section electrically connected to the image reading section for processing to convert image data read by the image reading section into perforating data;

a data holding section electrically connected to the image processing section for holding the perforating data as re-perforating data;

a control section electrically connected to the data holding section for controlling image perforating and printing operations, said control section, if required, retrieving the perforating data held in the data holding section as the re-perforating data;

an image perforating section electrically connected to the control section for thermally perforating a stencil sheet in accordance with an image of the perforating data from the image processing section and re-perforating another stencil sheet based on the re-perforating data by an operation of the control section, said image perforating section initially perforating the stencil sheet while the perforating data is being held in the data holding section;

a printing section for printing a print sheet by using the stencil sheet perforated by the image perforating section; and an operation panel section electrically connected to the control section and having a manual stencil making key for manually instructing a stencil remaking operation by the re-perforating data held in the data holding section, said control section reading the re-perforating data held in the data holding section and operating the image perforating section to perforate the another stencil sheet by an instruction input of a stencil remaking operation from the operation panel section.

3. A stencil printing machine comprising:

a data editing apparatus for editing and outputting image data;

a data developing apparatus electrically connected to the data editing apparatus for developing the image data outputted from the data editing apparatus to perforating data;

a data holding section electrically connected to the data developing apparatus for holding the perforating data as re-perforating data;

a control section electrically connected to the data holding section for controlling image perforating and printing operations, said control section, if required, retrieving the perforating data held in the data holding section as the re-perforating data;

an image perforating section electrically connected to the data control section for thermally perforating a stencil sheet in accordance with an image of the perforating data developed by the data developing apparatus and re-perforating another stencil sheet based on the re-perforating data by an operation of the control section;

a printing section for printing a print sheet by using the stencil sheet perforated by the image perforating section; and an operation panel section electrically connected to the control section and having a manual stencil making key for manually instructing a stencil remaking oneration by the re-perforating data held in the data holding section, said control section reading the re-perforating data held in the data holding section and operating the image perforating section to perforate the another stencil sheet by an instruction input of a stencil remaking operation from the operation panel section.

4. A stencil printing machine comprising:

a conversion processing section for processing to convert input image data into perforating data;

a data holding section electrically connected to the conversion processing section for holding the perforating data as re-perforating data;

a control section electrically connected to the data holding section for controlling stencil making and printing operations, said control section calculating a number of printing sheets when a printing is performed and, if required, retrieving the perforating data held in the data holding section as the re-perforating data;

a stencil making section electrically connected to the control section for perforating a stencil sheet based on the perforating data subjected to the conversion processing and re-perforating another stencil sheet based on the re-perforating data by an operation of the control section;

a printing section for printing the print sheets by using the perforated stencil sheet; and an operation panel section electrically connected to the control section and having a manual stencil making key for manually instructing a stencil remaking operation by the re-perforating data held in the data holding section, said control section reading the re-perforating data held in the data holding section and operating the stencil making section to perforate the another stencil sheet by an instruction input of a stencil remaking operation from the operation panel section, said control section also actuating the stencil making section to perforate the another stencil sheet by the re-perforating data held in the data holding section whenever a total number of print sheets by the stencil sheet reaches a predetermined number to chance to the another stencil sheet.

5. The stencil printing machine according to claim 4, wherein said control section automatically actuates the stencil making section to perforate the another stencil sheet by the re-perforating data held in the data holding section whenever the total number of the print sheets by the stencil sheet reaches the predetermined number; changes the stencil sheet to the another stencil sheet; and continues to perform printing.

6. A stencil printing method comprising the steps of:

processing image data to convert into perforating data;

perforating a first stencil sheet based on the perforating data subjected to the conversion processing;

holding the perforating data subjected to the conversion processing as re-perforating data;

printing print sheets by using the first stencil sheet;

instructing manually a stencil remaking operation;

re-perforating a second stencil sheet based on the re-perforating data held in the data holding section, and changing the first stencil sheet to the second stencil sheet; and printing print sheets by using the second stencil sheet.

7. A stencil printing method comprising the steps of:

processing image data to convert into perforating data;

perforating a first stencil sheet based on the perforating data subjected to the conversion processing;

holding the perforating data subjected to the conversion processing as re-perforating data;

printing print sheets by using the first stencil sheet;

re-perforating a second stencil sheet based on the re-perforating data held in the data holding section, and changing the first stencil sheet to the second stencil sheet; and printing print sheets by using the second stencil sheet wherein a new stencil sheet is perforated by the re-perforating data held in the data holding section when a stencil remaking operation is manually instructed or whenever a number of print sheets printed by one stencil sheet reaches a predetermined number of sheets.

8. A stencil printing machine comprising:

an image reading section for reading an image of an original document;

an image processing section electrically connected to the image reading section for processing to convert image data read by the image reading section into perforating data;

a data holding section electrically connected to the image processing section for holding the perforating data as re-perforating data;

a control section electrically connected to the data holding section for controlling image perforating and printing operations, said control section calculating a number of printing sheets when a printing is performed and, if required, retrieving the perforating data held in the data holding section as the re-perforating data;

an image perforating section electrically connected to the control section for thermally perforating a stencil sheet in accordance with an image of the perforating data from the image processing section and re-perforating another stencil sheet based on the re-perforating data by an operation of the control section, said image perforating section initially perforating the stencil sheet while the perforating data is being held in the data holding section;

a printing section for printing the print sheets by using the stencil sheet perforated by the image perforating section; and an operation panel section electrically connected to the control section and having a manual stencil making key for manually instructing a stencil remaking operation by the re-perforating data held in the data holding section, said control section reading the re-perforating data held in the data holding section and operating the image perforating section to perforate the another stencil sheet by an instruction input of a stencil remaking operation from the operation panel section, said control section also actuating the image perforating section to perforate the another stencil sheet by the re-perforating data held in the data holding section whenever a total number of print sheets by the stencil sheet reaches a predetermined number to change to the another stencil sheet.

9. A stencil printing machine comprising:

a data editing apparatus for editing and outputting image data;

a data developing apparatus electrically connected to the data editing apparatus for developing the image data outputted from the data editing apparatus to perforating data;

a data holding section electrically connected to the data developing apparatus for holding the perforating data as re-perforating data;

a control section electrically connected to the data holding section for controlling image perforating and printing operations, said control section calculating a number of printing sheets when a printing is performed and if required, retrieving the perforating data held in the data holding section as the re-perforating data;

an image perforating section electrically connected to the data control section for thermally perforating a stencil sheet in accordance with an image of the perforating data developed by the data developing apparatus and re-perforating another stencil sheet based on the re-perforating data by an operation of the control section;

a printing section for printing the print sheets by using the stencil sheet perforated by the image perforating section; and an operation panel section electrically connected to the control section and having a manual stencil making key for manually instructing a stencil remaking operation by the re-perforating data held in the data holding section, said control section reading the re-perforating data held in the data holding section and operating the image perforating section to perforate the another stencil sheet by an instruction input of a stencil remaking operation from the operation panel section, and said control section also actuating the image perforating section to perforate the another stencil sheet by the re-perforating data held in the data holding section whenever a total number of print sheets by the stencil sheet reaches a predetermined number to change to the another stencil sheet.

* * * * *